US005769298A

United States Patent [19]

Plumb

[11] Patent Number: 5,769,298

[45] Date of Patent: Jun. 23, 1998

[54] GUIDING APPARATUS FOR WEBS HAVING AT LEAST TWO THICKNESSES

[75] Inventor: John M. Plumb, Edmond, Okla.

[73] Assignee: Fife Corporation, Oklahoma City, Okla.

[21] Appl. No.: 900,908

[22] Filed: Jul. 25, 1997

[51] Int. Cl.[6] ..... B23Q 15/00

[52] U.S. Cl. ..... 226/19; 226/20; 226/45

[58] Field of Search ..... 226/21, 20, 45

[56] References Cited

U.S. PATENT DOCUMENTS

| | | | |
|---|---|---|---|
| 3,054,547 | 9/1962 | Alexeff et al. | 226/198 |
| 3,724,732 | 4/1973 | Bonner | 226/21 |
| 4,054,251 | 10/1977 | Henderson et al. | 242/57.1 |
| 4,261,498 | 4/1981 | Short | 226/3 |
| 4,364,502 | 12/1982 | Frentress | 226/45 |
| 4,848,632 | 7/1989 | Mack et al. | 226/18 |

FOREIGN PATENT DOCUMENTS

| | | | |
|---|---|---|---|
| 2305689 | 9/1973 | Germany | 226/21 |

*Primary Examiner*—William Stryjewski

*Attorney, Agent, or Firm*—Dunlap & Codding, P.C.

[57] ABSTRACT

The present invention relates to a guide apparatus for guiding a moving web of material having a tuft portion mounted on a backing portion such that the backing portion extends outwardly from the tuft portion to form at least one tuft edge. The web is movable in a web direction through a travel path threaded through the guide apparatus. The guide apparatus comprises a base and a platform pivotally mounted on the base to pivot about a pivot range. At least two parallel steering rollers are mounted on the platform and disposed transversely of the web direction of travel when the web travels across the platform. A sensor is positioned substantially adjacent to the travel path of the web to sense a lateral position of the tuft edge and to output an output signal indicative of the lateral position of the tuft edge when the web travels through the travel path. Control device for generating control signals responsive to the signals produced by the sensor for automatically correcting a deviation from a predetermined position of the web position. Finally, platform drive device responsive to the control signals generated by the control means is provided for pivoting the platform and thereby controlling the angular position of the platform relative to the base.

5 Claims, 11 Drawing Sheets

GUIDING APPARATUS FOR WEBS HAVING AT LEAST TWO THICKNESSES

BACKGROUND OF THE INVENTION

Offset pivot guiding systems for guiding continuous webs of material, such as carpet are well known in the art. These continuous webs of carpet are generally formed from a tuft mounted on a backing such that the backing extends outwardly from the tuft to form a pair of opposing tuft edges. The conventional offset pivot guides typically use C-shaped sensors positioned on the edges of the moving web of carpet such that the portion of the backing extending outwardly from the tuft is substantially surrounded by the C-shaped sensor. For these conventional web guiding systems to function correctly, the portion of the backing extending outwardly from the tuft needs to have a uniform width and opacity (which is not always the case). After the carpet has been manufactured, this excess backing extending from the tuft edge is typically trimmed and subsequently incinerated or disposed in a landfill.

In the past, guiding systems for guiding carpet would use a reflected light line guide sensor with ultra-violet lamps. A sensor like this could sense a row of tuft made of yarn containing fluorescent dye. The carpet manufacturers stopped using these guide sensors because of several inherent problems, such as the carpet having different colors, irregular edges, sculptured surfaces, various tuft heights, tuft edges which weave in and out and backings which are opaque or translucent. These problems made it virtually impossible for the prior art reflected light line guide sensor to effectively and reliably guide the carpets for extended periods of time.

If one could reliably guide the web of carpet without guiding to the opposed edges of the backing material, then the amount of backing material utilized in manufacturing the web of carpet could be reduced, thereby lowering the cost of manufacturing the carpet and disposing of the excess backing. It is to such an improved web guiding device for reliably guiding continuous webs of material such as carpet that the present invention is directed.

BRIEF SUMMARY OF THE INVENTION

The present invention relates generally to a guide apparatus for center or edge guiding a moving web of material, such as carpet, having a tuft mounted on a backing such that the backing extends outwardly from the tuft to form a pair of opposing tuft edges. The tuft edges form a transition or step between the tuft and the backing in a cross-sectional profile of the moving web of material (the tuft edges are depicted in FIG. 3). The tuft has a height extending from the backing and the web is movable in a web direction through a travel path.

The guide apparatus generally comprises a base, a platform, one or more sensors, control means, platform drive means and a sensor positioner assembly. The platform is pivotally mounted on the base to pivot over a predetermined pivot range about a pivot point. The platform has a second end and an axis extending generally between the first end and the second end thereof.

The platform is provided with at least one parallel steering roller rotatable about an axis extending transversely of the web direction of travel. One of the steering rollers can be an entry roller mounted to the platform near the first end thereof. At least one other of the steering rollers can form an exit roller mounted near the second end of the platform.

The two sensors of the guide apparatus are positioned across the opposing tuft edges, respectively, of the material to sense a lateral position or transverse deviation of such tuft edges with respect to the web direction of travel. Each sensor includes a transmitter transmitting a sensor media having a thickness less than the height of the tuft, and a width sufficiently large to extend across one of the tuft edges so that at least a portion of the sensor media can be blocked by the tuft as the material travels through a portion of the travel path substantially adjacent the sensor. Each sensor further includes a receiver receiving at least a portion of the sensor media transmitted by the transmitter which was not blocked by the tuft to provide an output signal indicative of the transverse position of the tuft edge. The transmitter and receiver of each sensor are positioned such that the sensor media extends substantially parallel to the tuft edges.

The control means generate control signals responsive to the signals produced by the sensors for automatically correcting the deviation of the web position. When the sensor positioner assembly is a moving sensor center guide, the control means also generates control signals responsive to the signals produced by the sensors for automatically correcting the sensor positions with respect to the distance between the opposing tuft edges of the web.

The platform drive means is responsive to at least some of the control signals generated by the control means for pivoting the platform to control the angular position of the platform relative to a predefined centerline or edge of the guide process.

The sensor positioner assembly has a first end, a second end, and a longitudinal axis extending therebetween. The sensor positioner assembly supports the two sensors such that each sensor is maintained the same distance from a predetermined center line in response to at least some of the control signals generated by the control means when the guide apparatus is operating in a moving sensor center guiding mode. Each of the two sensors is positioned by the sensor position apparatus to sense the transverse positions of one tuft edge.

Finally, in some embodiments, a means for maintaining a substantially fixed physical (angular and/or dimensional) relationship between the sensor media of each of the sensors and the web direction of travel substantially adjacent to the sensor media as the platform pivots is provided with the guide apparatus.

By the sensors sensing the transverse position of the tuft edges, the present guide apparatus permits one to guide a web of carpet, for example, with respect to the tuft edges. This reduces the amount of backing material which is utilized in the manufacture of carpet to permit carpet to be manufactured more inexpensively by utilizing the guide apparatus of the present invention than the conventional offset pivot guides utilizing C-shaped sensors.

Other objects, features and advantages of the present invention will become apparent to those of ordinary skill in the art upon a review of the present specification, the attached drawings and the appended claims.

BRIEF DESCRIPTION OF THE SEVERAL VIEWS OF THE DRAWING

FIG. 8 is a top plan view of the guide apparatus depicted in FIGS. 6 and 7 wherein a platform of the guide apparatus is pivoted to correct to a first side of the platform.

FIG. 13 is a top plan view of the guide apparatus depicted in FIG. 12.

DETAILED DESCRIPTION OF THE INVENTION

Figure 1:
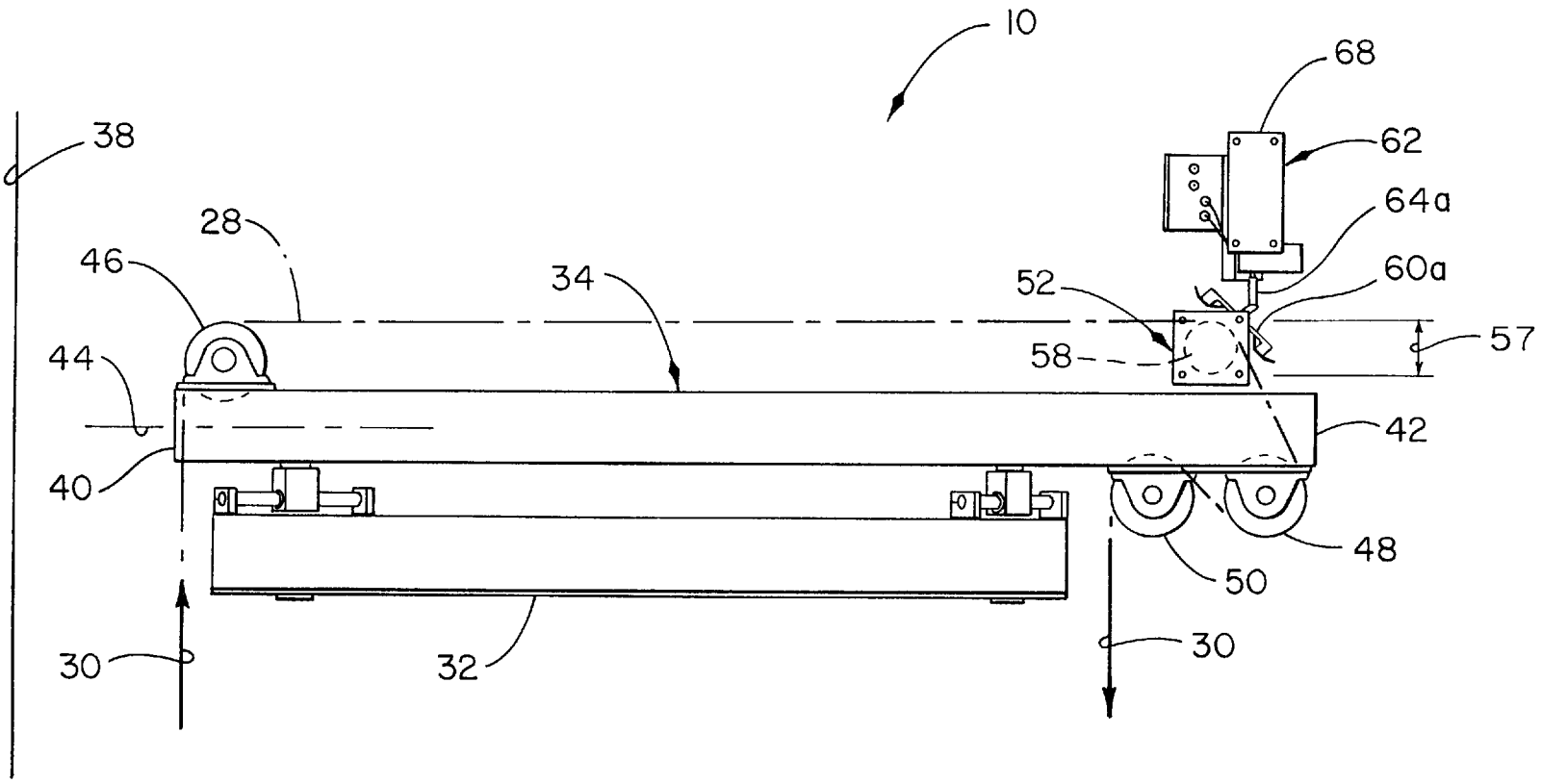
FIG. 1 is a side elevational, pictorial representation of a guide apparatus constructed in accordance with the present invention having a plurality of parallel steering rollers supported by a pivotal platform and illustrating a section of material threaded through the steering rollers such that the guide apparatus can guide the material.
Figure 2:
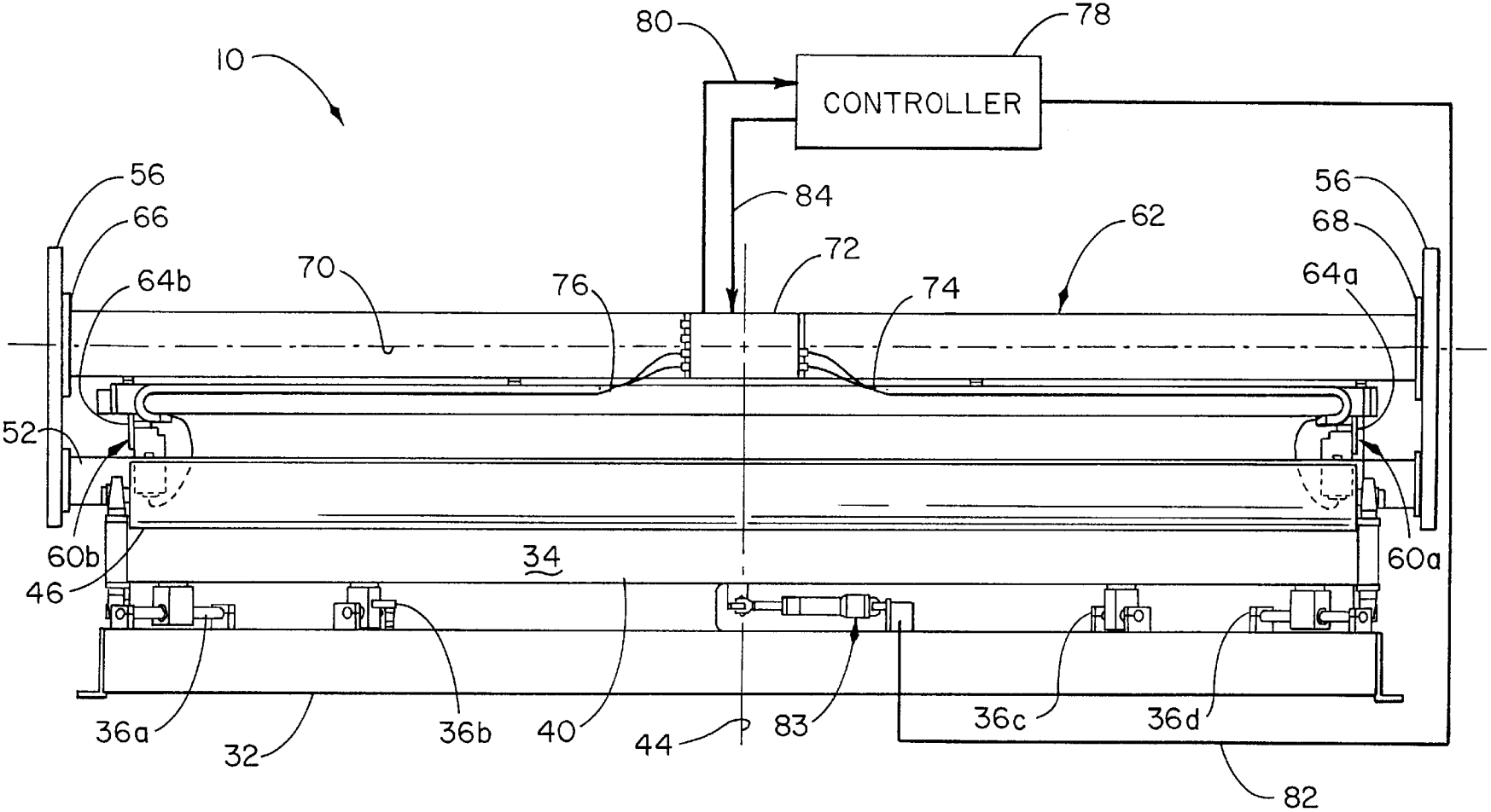
FIG. 2 is an entry elevational view of the guide apparatus depicted in FIG. 1.

Referring now to the drawings and more particularly to FIGS. 1 and 2, shown therein and designated by the general reference numeral 10 is a guide apparatus for guiding a continuous moving web of material 12 having a tuft or pile portion 14 (FIGS. 3 and 4) mounted on a backing portion 16 (FIG. 3) such that opposing portions 18 and 20 (FIG. 3) of the backing portion 16 extend outwardly from the tuft portion 14 to form a pair of opposing tuft edges 22 and 24 forming a transition or step between the tuft portion 14 and the backing portion 16. The tuft portion 14 of the material 12 has a height 26 (FIGS. 3 and 4) and the web of material 12 is generally movable through a travel path 28 (FIG. 1) in a web direction 30. The travel path 28 is depicted in FIG. 1 as dashed lines, and the web direction 30 is depicted via arrows.

It should be understood that the term "material" as used herein refers to any flexible web having a tuft, pile or other material mounted on a backing, support, foundation or other material to form a transition, step or edge therebetween which is capable of being guided by any of the guide apparatuses disclosed herein, such as the guide apparatus 10. It should also be understood that the tuft portion 14 and the backing portion 16 can be integrally formed to provide a unitary structure, separate and connected, layered and combinations thereof. For example, the material 12 can be carpet, diapers, feminine products, various layered products such as tires, or any other web of material having different thicknesses.

The guide apparatus 10 is a displacement type guide provided with a base 32. A platform 34 is pivotally mounted and supported on the base 32 via conventional linear slides 36*a*, 36*b*, 36*c*, and 36*d* (FIG. 2) to pivot about a pivot point 38 (FIG. 1) disposed near a first end 40 of the platform 34. The platform 34 is further provided with a second end 42 spaced a distance from and disposed generally opposite the first end 40, and a central axis 44 extending generally between the first end 40 and the second end 42 of the platform 34. The central axis 44 is depicted in FIG. 2 as a dot extending generally into the page.

The guide apparatus 10 further includes three parallel steering rollers 46, 48, and 50 rotatable about an axis (not shown) extending transversely of the web direction 30 of the travel path 28 of the material 12. The steering roller 46 is disposed adjacent to the first end 40 of the platform 34. As shown in FIG. 1, the material 12 enters the guide apparatus 10 adjacent to the steering roller 46 (the steering roller 46 may be designated herein as an "entry roller") and is threaded over the steering roller 46 as the material 12 moves through the travel path 28.

The steering rollers 48 and 50 are disposed substantially adjacent to the second end 42 of the platform 34. The steering rollers 48 and 50 may be designated as "exit rollers" in that the material 12 generally exits the guide apparatus 10 adjacent to the steering rollers 48 and 50 as the material 12 moves through the travel path 28.

A stationary, non-rotatable bar 52 is positioned generally between the entry roller 46 and the exit rollers 48 and 50 in the travel path 28 of the material 12. The bar 52 has an axis 54 (FIG. 3) extending transversely of the web direction 30 of the travel path 28 of the material 12. The stationary, non-rotatable bar 52 is mounted to a mounting frame 56 (FIG. 2) and supported thereby. The mounting frame 56 is provided separately from the platform 34 such that the pivoting of the platform 34 will not affect the alignment and/or support of the bar 52 as the platform 34 pivots. The bar 52 typically has a diameter 57 of about one to about twenty-five inches and desirably between about six to eight inches.

As shown in FIG. 1, the travel path 28 of the material 12 extends sequentially over the entry roller 46, an arcuate surface 58 provided on the bar 52, and is then threaded between the exit rollers 48 and 50 substantially as shown such that the backing portion 16 of the material 12 engages the steering rollers 46 and 48 and the bar 52, and the tuft portion 14 of the material 12 engages the steering roller 50.

The bar 52 functions to alter the travel path 28 in a direction substantially perpendicular to the web direction of travel 30 between the entry roller 46 and the exit rollers 48 and 50 so as to maintain the travel path 28 in a predetermined position.

The guide apparatus 10 is provided with two sensors designated in FIGS. 1 and 2 as 60*a* and 60*b*. Each of the sensors 60*a* and 60*b* is positioned to sense the transverse position or deviation of one of the tuft edges 22 and 24, respectively, of the material 12 as the material 12 slides over the arcuate surface 58 of the bar 52.

The construction and function of the sensors 60*a* and 60*b* will be described hereinafter with respect to FIGS. 4 and 5.

As shown in FIGS. 1 and 2, the guide apparatus 10 is provided with a sensor positioner assembly 62 supporting the sensors 60*a* and 60*b* adjacent to the arcuate surface 58 of the bar 52 via linkages 64*a* and 64*b*. The sensor positioner assembly 62 has a first end 66, a second end 68, and a longitudinal axis 70 extending therebetween. The first end 66 and the second end 68 of the sensor positioner assembly 62 are secured to the mounting frame 56 such that the longitudinal axis 70 extends generally transversely of the web direction 30 of the travel path 28. As will be understood by those of ordinary skill in the art, the sensor positioner assembly 62 can function as a moving sensor center guide positioner assembly, a fixed sensor center guide positioner assembly or a fixed edge guide sensor positioner assembly.

When the sensor positioner assembly 62 functions as the moving sensor center guide positioner assembly, the sensor positioner assembly 62 functions to selectively move the sensors 60*a* and 60*b* in a linear direction along the longitudinal axis 70 either toward each other or away from each other in a manner well known in the art for center guiding the moving web of material 12. The sensor positioner assembly 62 can be provided with a servo motor means, a hydraulic means or any other suitable means with associated linkages for selectively moving the sensors 60*a* and 60*b* as previously discussed and to maintain the sensors 60*a* and 60*b* a same distance from a predetermined center line of the sensor positioner assembly 62 when the sensor positioner assembly 62 functions as the moving center sensor positioner assembly.

When the sensor positioner assembly 62 functions as the fixed sensor center guide positioner assembly, the sensors 60*a* and 60*b* are desirably maintained in a fixed, spaced-apart position adjacent to the tuft edges 22 and 24, respectively as the web of material 12 moves along the travel path 28.

When the sensor positioner assembly 62 functions as the fixed edge guide sensor positioner assembly, only one of the sensors 60*a* and 60*b* is utilized and positioned to sense one of the tuft edges 22 and 24. The sensor positioner assembly 62 is desirably programmed to function as the fixed edge guide sensor positioner assembly when guiding webs of material 12 having a known, uniform width extending between the tuft edges 22 and 24 so as to eliminate the cost and expense of providing both of the sensors 60*a* and 60*b*.

In operation, each of the sensors 60*a* and 60*b* senses the transverse position of one of the tuft edges 22 and 24 to generate an output signal indicative of the transverse position of the respective tuft edges 22 and 24. The signals output by the sensors are provided to a terminal box 72 (FIG. 2) via respective signal paths 74 and 76. In response thereto, the output signals received from the sensors 60*a* and 60*b* are transmitted to a controller 78 via a signal path 80. In response to receiving the output signals from the sensors 60*a* and 60*b*, the controller 78 compares such signals to a predetermined guide point position and then sends a control signal over a signal path 82 to a guide drive assembly 83 connected between the base 32 and the platform 34 to reposition or pivot the platform 34 relative to the base 32 so as to reposition the material 12 to the predetermined guide point position. The guide drive assembly 83 can be a servo-motor means, a hydraulic means or any other suitable means capable of selectively repositioning the platform 34 relative to the base 32.

Upon receipt of the output signals by the sensors 60*a* and 60*b*, the controller 78 also compares the two signals to determine whether the width of the tuft portion 14 of the material 12 has changed when center guiding the moving web of material 12. If the width of the tuft portion 14 has changed, the controller 78 outputs control signals to the sensor positioner assembly 62 via a signal path 84 to adjust the distance between the sensor 60*a* and the sensor 60*b* as previously discussed so as to guide the material 12 to a predetermined centerline of the material 12.

Figure 4:
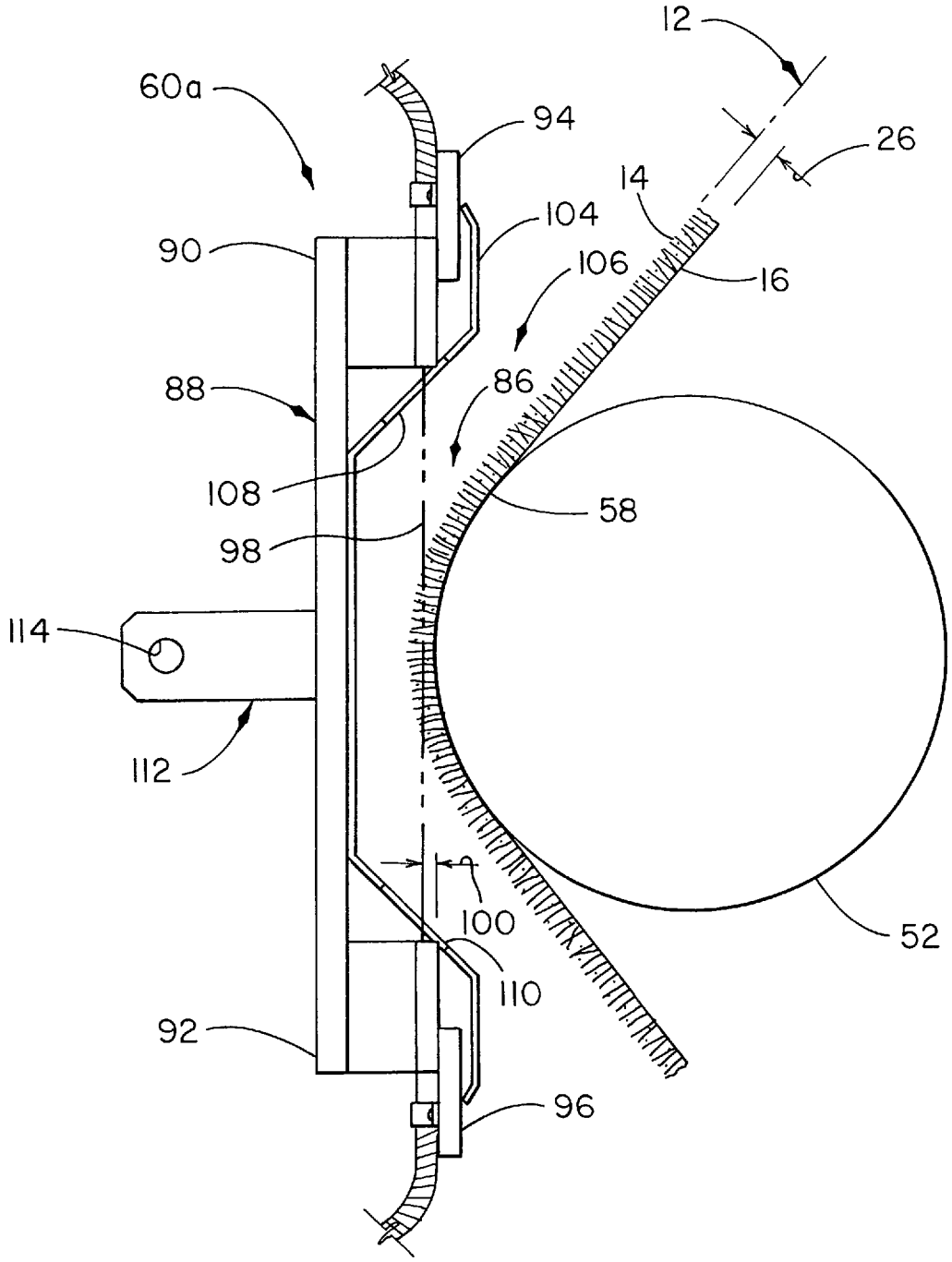
FIG. 4 is a side elevational pictorial representation of material traveling over a stationary bar so as to bend the material, and a sensor disposed adjacent to the stationary bar such that a sensor media is transmitted across the bent material to determine the transverse position of the material.
Figure 5:
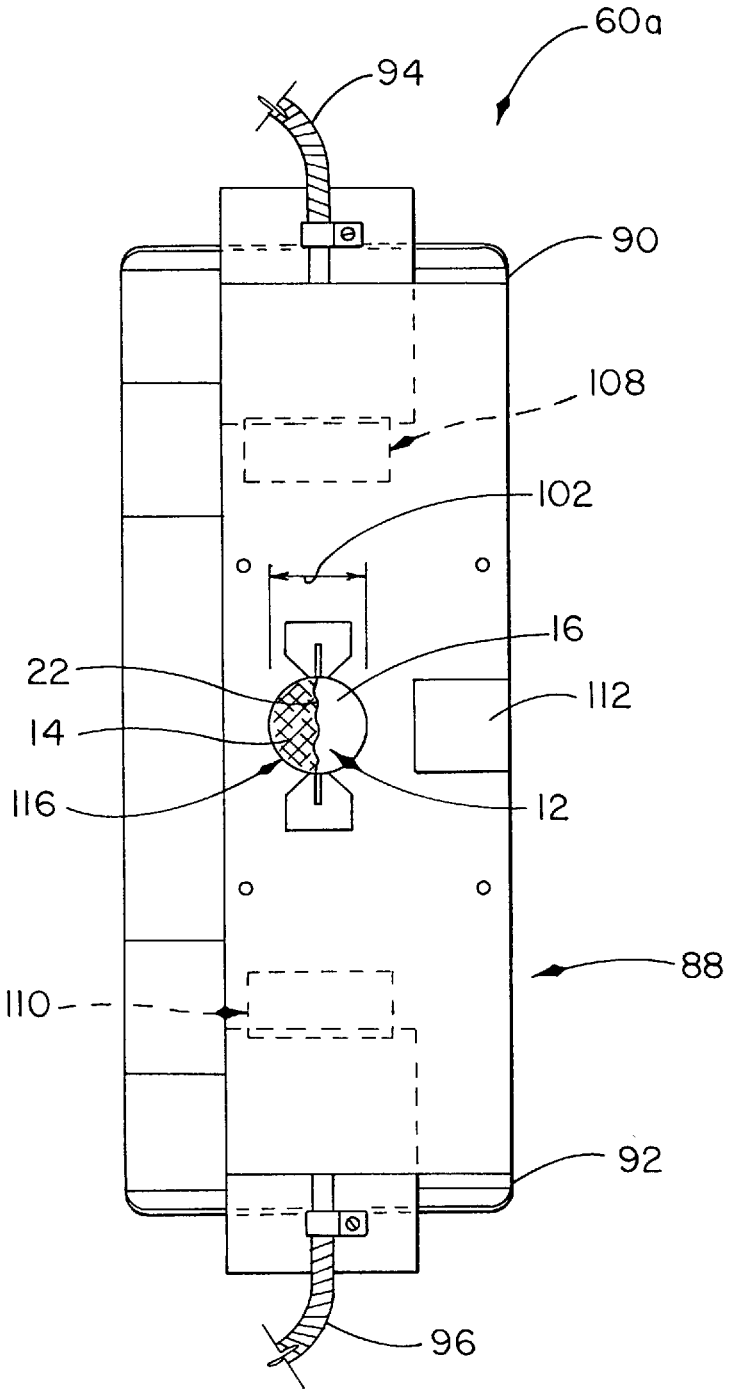
FIG. 5 is a top plan view of the sensor depicted in FIG. 4.

Referring now to FIGS. 4 and 5, depicted therein is the sensor 60*a* positioned adjacent to the bar 52 with a segment of the material 12 disposed between the sensor 60*a* and the bar 52 such that the backing portion 16 of the material 12 engages the arcuate surface 58 of the bar 52 to provide a bent portion 86 of the material 12. The sensors 60*a* and 60*b* are constructed and function identically. Thus, only a description of the making and the using of the sensor 60*a* will be provided herein for purposes of clarity.

The sensor 60*a* is provided with a bracket 88 having a first end 90 and a second end 92. A transmitter 94 is connected to the first end 90, and a receiver 96 is connected to the second end 92.

Figure 3:
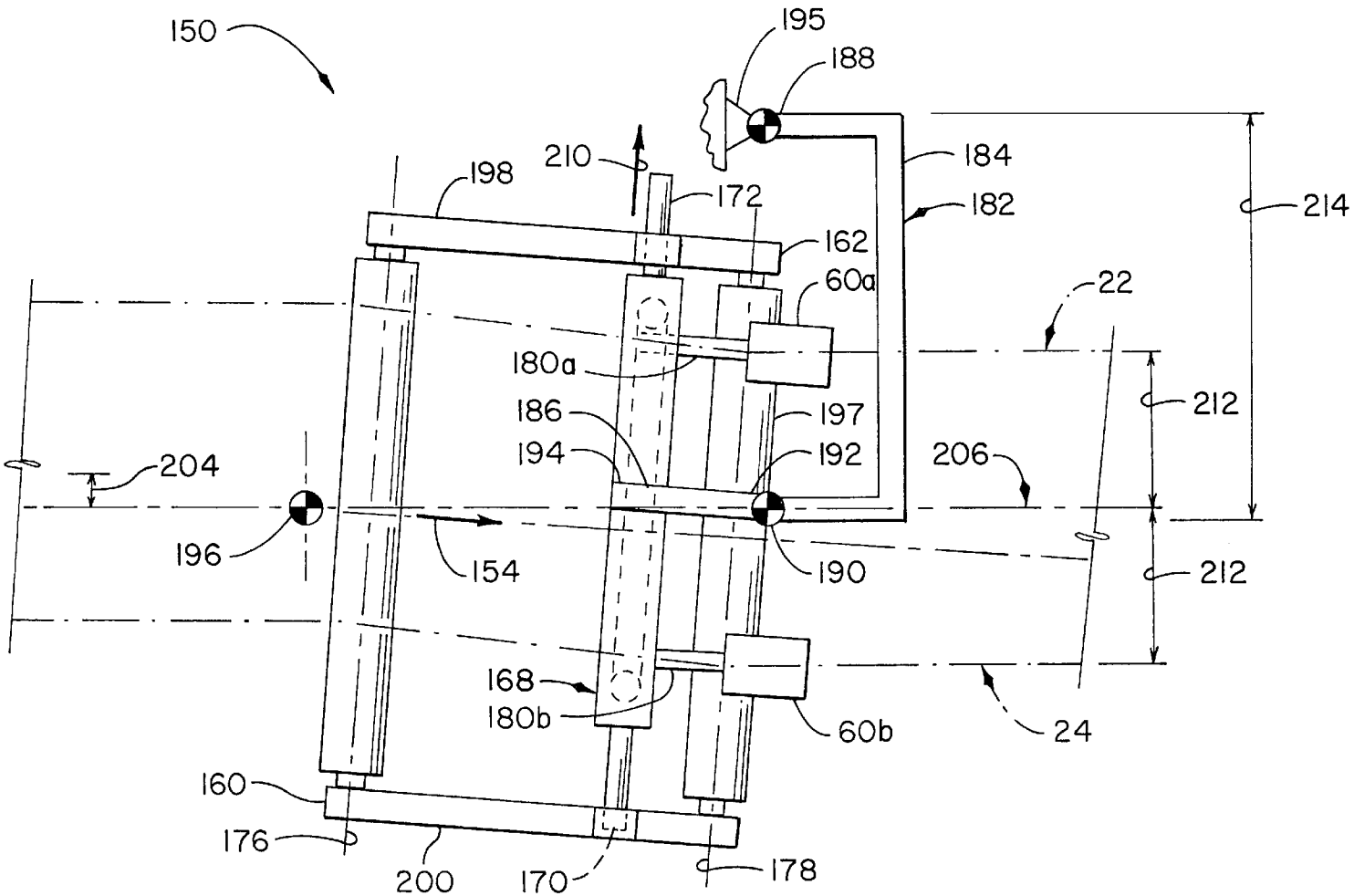
FIG. 3 is a partial cross-sectional, front elevational pictorial representation of a bent section of material travelling over a stationary bar.
Figure 11:
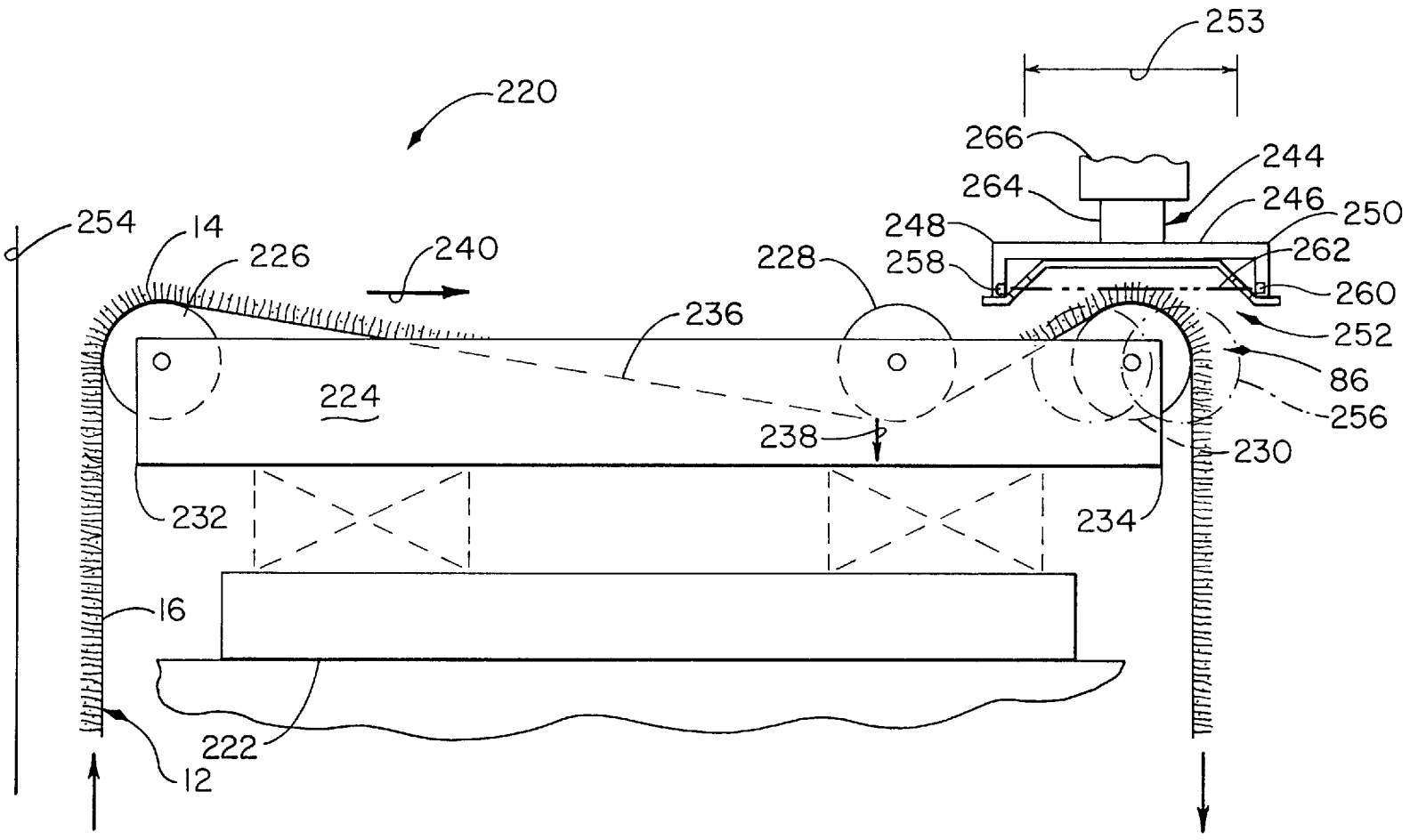

The transmitter 94 transmits a sensor media 98 (the sensor media 98 being indicated by the dashed lines in FIG. 4 and solid lines in FIG. 3) having a thickness 100 which is desirably less than the height 26 of the tuft portion 14. It should be understood that the thickness 100 can be greater than the height 26 of the tuft portion 14. As shown in FIGS. 3 and 4, the sensor media 98 of each sensor 60*a* and 60*b* extends across one of the tuft edges 22 and 24 such that the sensor media is spaced a distance from the backing portion 16 less than the height 26 of the tuft portion 14 and such that as the bent portion 86 of the material 12 moves laterally across the bar 52, the amount of the sensor media 98 blocked by the tuft portion 14 changes in a predetermined manner. It should be noted that the sensor media 98 has a width 102 (FIGS. 3 and 5) of typically about at least ½ cm. such that the width 102 is sufficiently large to extend across one of the tuft edges 22 and 24.

The receiver 96 receives at least a portion of the sensor media 98 transmitted by the transmitter 94 which was not blocked by the tuft portion 14 to provide the output signal indicative of the transverse position of one of the tuft edges 22 and 24. It should be noted that the transmitter 94 and the receiver 96 are positioned such that the sensor media 98 extends substantially parallel to the tuft edges 22 and 24.

The sensor media 98 can be any media capable of having a width 102 sufficient to extend across one of the tuft edges 22 and 24 and to maintain a desirable amount of sensitivity in the sensors 60*a* and 60*b*. For example, the sensor media 98 typically has a thickness of less than about ⅛ of an inch and a width of about at least ½ cm. Examples of suitable sensor medias are lasers, air, visible light, infrared light, ultraviolet light, sound waves, and combinations thereof.

The sensor 60*a* is further provided with a guard 104 forming a bent material receiving space 106 adapted to receive the bent portion 86 of the material 12 and at least a portion of the bar 52.

The guard 104 is provided with a pair of openings 108 and 110 so that the sensor media 98 can pass unobstructed by the guard 104 from the transmitter 94 to the receiver 96.

A mounting tab 112 is connected to the bracket 88 and extends therefrom. The mounting tab 112 is provided with an opening 114 formed therethrough to receive a bolt or threaded bracket, for example, so that the mounting tab 112 can be rigidly fixed to the linkage 64*a* of the sensor positioner assembly 62. As shown in FIG. 5, the bracket 88 is provided with a viewing port 116 such that a user can see the tuft edge 22 of the material 12 for purposes of alignment prior to the automatic operation of the guide apparatus 10.

Although the bar 52 has been shown and described in FIGS. 1, 2, and 4 as having a circular configuration, it should be understood that the bar 52 can have any suitable configuration such as rectangular, or triangular, so long as the material 12 can be bent thereabout to permit the sensor media 98 to be scanned across the tuft edge 22 and/or 24 without obstruction from the backing portion 16.

It should be apparent to those of ordinary skill in the art that the bar 52 is fixed relative to the travel path 28 of the material 12 such that the material 12 slides across the bar 52 as the material 12 moves through the travel path 28. In addition, it should also be understood that the guide apparatus 10 functions to maintain a substantially fixed physical relationship or centerline between the sensor media 98 of the sensors 60*a* and 60*b* and the travel path 28 of the material 12 substantially adjacent to the sensors 60*a* and 60*b* as the platform 34 pivots. In other words, the controller 78 is programmed to maintain the travel path 28 of the material 12 in a same position on the bar 52 by correcting the angular position of the platform 34 in response to any deviations of the travel path 28 of the material 12 from the predetermined position. Thus, the guide apparatus 10 functions to maintain the travel path 28 in the same position on the bar 52 as the material 12 travels through its predetermined travel path.

It will also be apparent to those of ordinary skill in the art that a sufficient amount of wrap about the steering rollers 46, 48, and 50 by the material 12 is necessary to maintain sufficient friction or traction for guiding to prevent slippage of the material 12 on the steering rollers 46, 48, and 50 as the guide apparatus 10 operates. In the embodiment shown in FIGS. 1 and 2, there is typically about 90° degrees of wrap on the steering roller 46, about 60° degrees of wrap on the bar 52, and about 300° degrees of wrap combined on the steering rollers 48 and 50. However, it should be apparent to those of ordinary skill in the art that the particular amount of wrap on the steering rollers 46, 48 and 50 will depend on the dimensions of the guide apparatus, the particular type of rollers utilized and the type of material 12 being guided. It should also be apparent to those of ordinary skill in the art that in some applications it is only necessary to provide one of the steering rollers 48 and 50 as the exit roller and that the present invention should not be limited to using two exit rollers.

It should also be understood that the steering rollers 48 and 50 can be provided on the same side of the platform 34 as the steering roller 46 so long as a sufficient amount of wrap is provided around the steering rollers 48 and/or 50 to prevent slippage of the web of material 12 thereon.

Although it is not necessary that the bar 52 and the sensors 60*a* and 60*b* be provided substantially adjacent to the steering rollers 48 and 50 as shown, it should be understood that the closer that the bar 52 and sensors 60*a* and 60*b* are provided to such steering rollers 48 and 50, the more sensitive that the guide apparatus 10 will be to lateral deviations in the direction of the material 12. Thus, It is desirable that the bar 52 and the sensors 60*a* and 60*b* be provided as close to the steering rollers 48 and 50 as possible without sacrificing a sufficient amount of wrap of the material 12 about such steering rollers 48 and 50 to prevent slippage.

Figure 6:
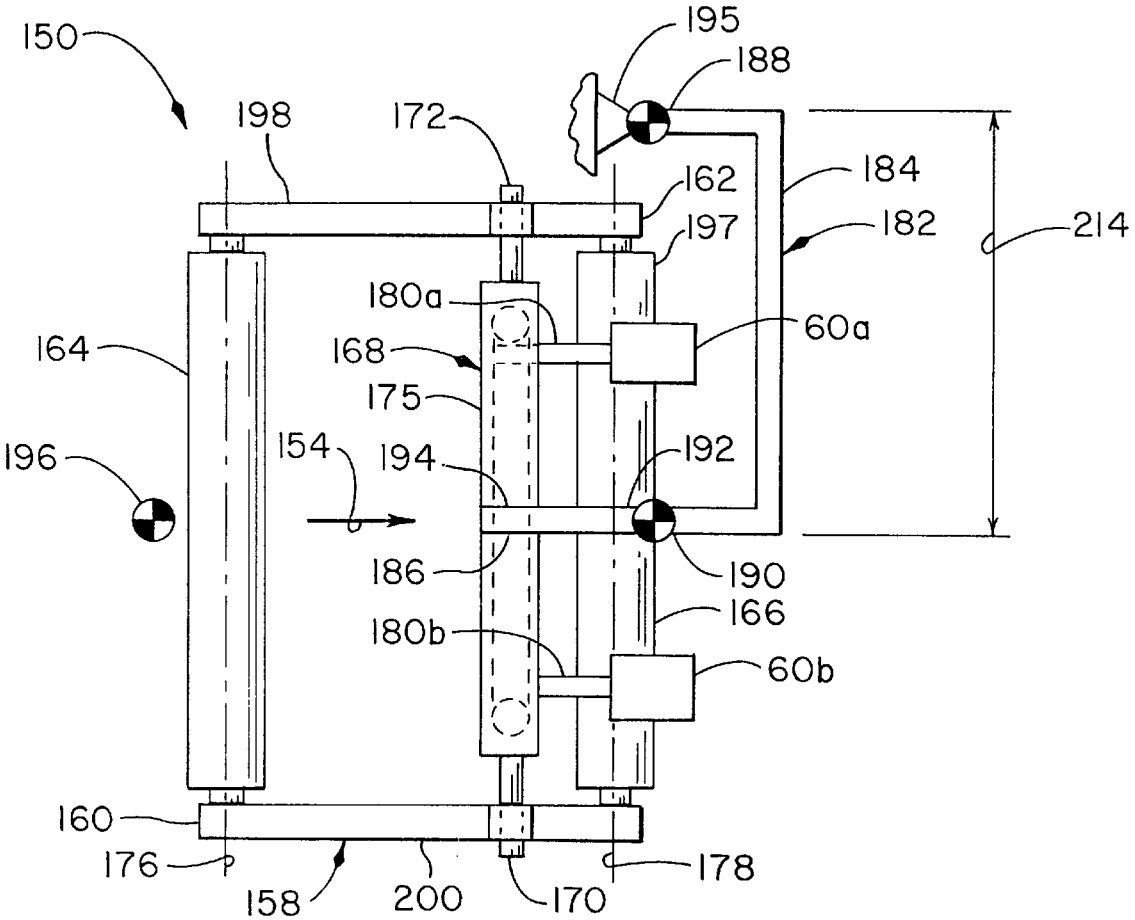
FIG. 6 is a top plan view of another embodiment of the guide apparatus constructed in accordance with the present invention.
Figure 7:
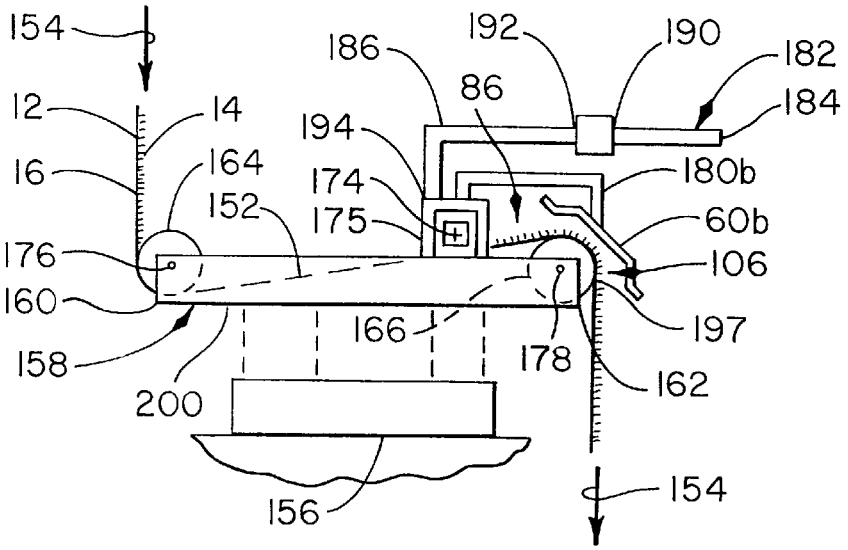
FIG. 7 is a side elevational view of the second embodiment of the guide apparatus depicted in FIG. 6.

Referring now to FIGS. 6 and 7, shown therein and designated by the general reference numeral 150 is a second embodiment of a guide apparatus constructed in accordance with the present invention for guiding the moving web of material 12 (FIG. 7) through a travel path 152 moving in a web direction 154. The guide apparatus 150 is provided with a base 156 (FIG. 7) rigidly supported on a floor, for example. A platform 158 is pivotally mounted on the base 156 in an identical manner as the platform 34 is pivotally mounted on the base 32 of the guide apparatus 10, hereinbefore described with reference to FIGS. 1 and 2. The platform 158 has a first end 160 and a second end 162. An entry roller 164 is mounted to the platform 158 near the first end 160 thereof, and an exit roller 166 is mounted to the platform 158 near the second end 162 thereof. The guide apparatus 150 is provided with a sensor positioner assembly 168 having a first end 170, a second end 172, a central axis 174 (FIG. 7) extending therebetween and a housing 175. The housing 175 is positioned generally near the travel path 152 of the material 12. The first end 170 and the second end 172 are mounted on the platform 158 to permit the sensor positioner assembly 168 to slide linearly back and forth along its central axis 174. The central axis 174 of the sensor positioner assembly 168 is disposed in a parallel relationship to an axis 176 of the entry roller 164, and an axis 178 of the exit roller 166.

The sensor positioner assembly 168 functions identically to the sensor positioner assembly 62 hereinbefore described with reference to FIGS. 1 and 2. The sensor positioner assembly 168 supports the sensors 60*a* and 60*b* via the linkages 180*a* and 180*b*, respectively, such that the bent portion 86 of the material 12 and at least a portion of the exit roller 166 are disposed in the bent material receiving space 106 (as hereinbefore described with reference to FIG. 4) such that the sensors 60*a* and 60*b* can provide output signals indicative of the transverse position or lateral deviation of the tuft edges 22 and 24 of the material 12 as the material 12 moves through the travel path 152. The sensor positioner assembly 168 functions to maintain the sensors 60*a* and 60*b* a fixed distance from a predetermined center line of the material 12 when center guiding the material 12 in a similar manner as the sensor positioner assembly 62, hereinbefore described with reference to FIGS. 1 and 2.

The output of the sensors 60*a* and 60*b* is supplied to a controller (not shown in FIGS. 6 and 7 for purposes of clarity) which operates in an identical manner as the controller 78 hereinbefore described with reference to FIGS. 1 and 2 to provide control signals to the sensor positioner assembly 168, and a guide drive assembly (also not shown in FIGS. 6 and 7 for purposes of clarity) constructed identically as the guide drive assembly 83 hereinbefore described with reference to FIGS. 1 and 2.

The guide apparatus 150 is further provided with a centering linkage assembly 182. The centering linkage assembly 182 is provided with a first member 184 and a second member 186. The first member 184 and the second member 186 are both constructed of rigid materials, such as steel. The first member 184 has a first end 188 and a second end 190. The second member 186 has a first end 192 and a second end 194. The first end 188 of the first member 184 is pivotally connected to a solid object 195, such as ground.

The second end 190 of the first member 184 extends directly adjacent to the exit roller 166, substantially as shown. The first end 192 of the second member 186 is pivotally connected to the second end 190 of the first member 184 such that the pivotal connection formed therebetween is substantially aligned with the pivotal connection connecting the first end 188 to the solid object 195, and is aligned with the sensors 60*a* and 60*b*. The sensors 60*a* and 60*b* are desirably positioned adjacent to an outer edge 197 of the exit roller 166 as shown in FIGS. 6 and 7.

The second end 194 of the second member 186 is rigidly or nonpivotally attached to a central or middle position of the sensor positioner assembly 168. The pivotal connection connecting the first end 188 to the solid object 195 and the pivotal connection connecting the first end 192 of the second member 186 to the second end 190 of the first member 184 both pivot in the same planar direction that the platform 158 pivots about a pivot point relative to the base 156.

Figure 9:
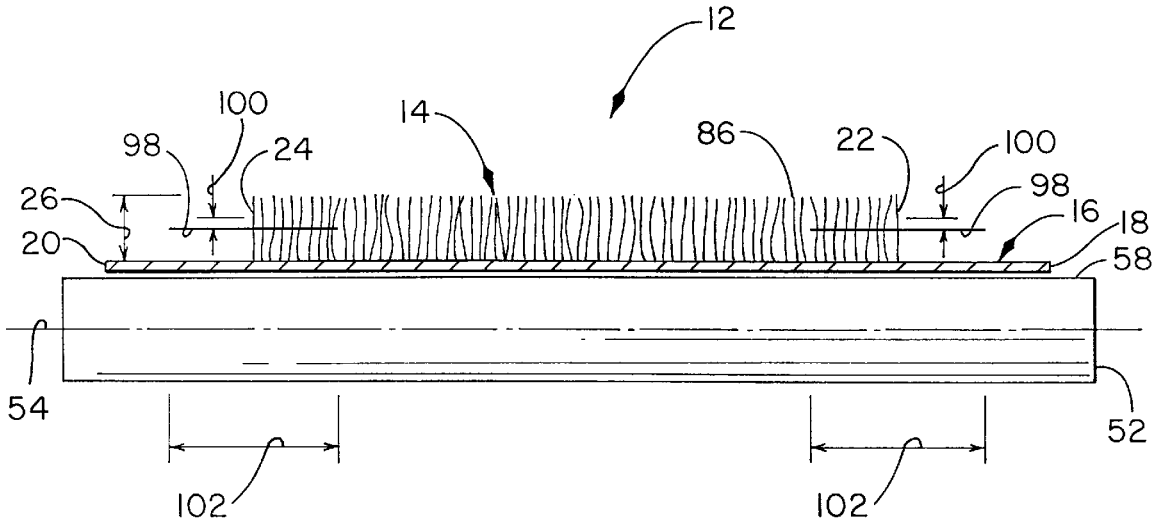
FIG. 9 is a top plan view of the guide apparatus depicted in FIGS. 6 and 7 wherein the platform of the guide apparatus is pivoted to correct to a second side of the platform.

Referring now to FIGS. 8 and 9, shown therein is the guide apparatus 150 being pivoted to correct to a first side 198 of the platform 158 (FIG. 8) and being pivoted in an opposite direction to correct to a second side 200 of the platform 158 (FIG. 9) to correct for lateral deviations 202 and 204, respectively, from a predefined centerline 206 of the carpet 12. As shown in FIG. 8 the centering linkage assembly 182 applies force to the sensor positioner assembly 168 to slide the sensor positioner assembly 168 in a first direction 208 when the platform 158 pivots to correct to the first side 198 to maintain the relative position of the sensors 60*a* and 60*b* to the exit roller 166 and the tuft edges 22 and 24. As shown in FIG. 9, the centering linkage assembly also applies force to the sensor positioner assembly 168 in a second direction 210 when the platform pivots to correct to the second side 200 to maintain the relative position of the sensors 60*a* and 60*b* to the exit roller 166 and the tuft edges 22 and 24. In addition, the centering linkage assembly 182 functions to maintain the sensors 60*a* and 60*b* a fixed distance 212 from the predefined centerline 206 such that the sensors 60*a* and 60*b* are maintained in a fixed physical relationship to the tuft edges 22 and 24 as the platform 158 pivots.

The first member 184 has a length 214 extending generally between the first end 188 and the second end 190 thereof. The length 214 of the first member 184 is desirably as long as possible given the size constraints of a given installation. At a minimum, the length 214 should be sized such that the pivotal connection connecting the first end 188 of the first member 184 to the support structure does not interfere with the movement of the platform 158.

Figure 10:
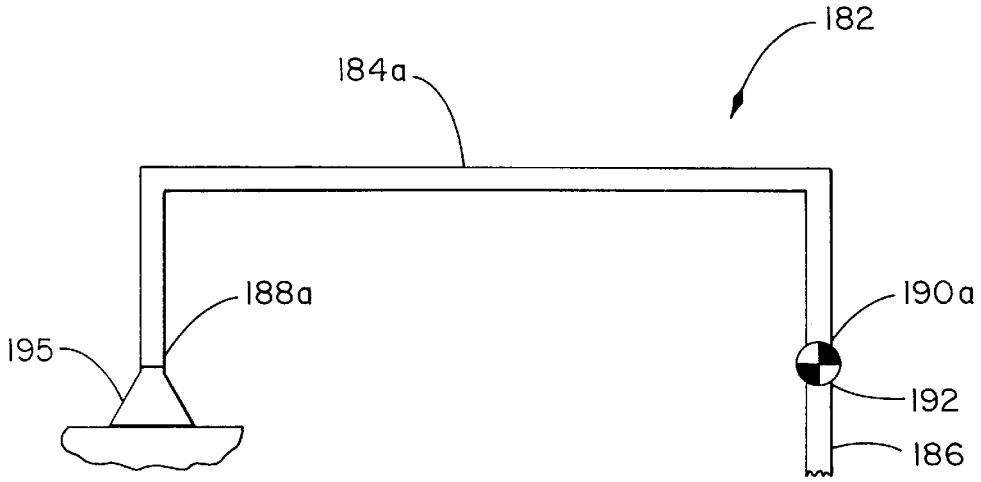
FIG. 10 is a top plan view of a second embodiment of a first member for use with a centering linkage assembly of the guide apparatus depicted in FIGS. 6–9.

Referring now to FIG. 10, shown therein and designated by the reference numeral 184*a* is a second embodiment of a first member constructed in accordance with the present invention for use in the centering linkage assembly 182 hereinbefore described with reference to FIGS. 6–9. The first member 184*a* has a first end 188*a* and a second end 190*a*. The first end 188*a* of the first member 184*a* is adapted to be rigidly (non-pivotally) connected to the solid object 195. The second end 190*a* of the first member 184*a* is adapted to be pivotally connected to the first end 192 of the second member 186. To permit the second end 190*a* to move relative to the first end 188*a* as the platform 158 pivots, the first member 184*a* is constructed of a substantially rigid, yet slightly flexible material having a memory, such as spring steel.

Figure 11:
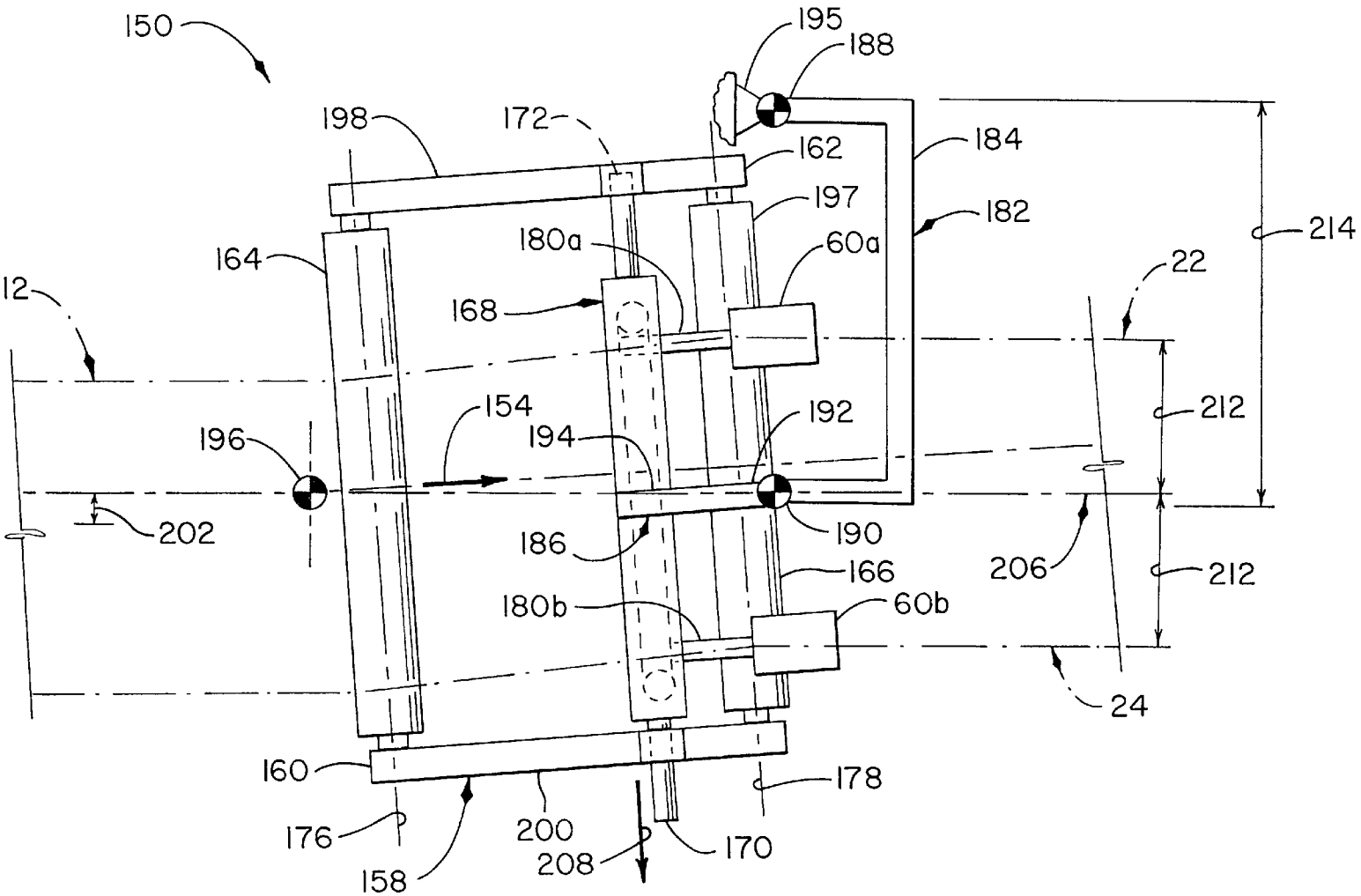
FIG. 11 is a side elevational view of a third embodiment of a guide apparatus constructed in accordance with the present invention for guiding a continuous web of material.

Referring now to FIG. 11, shown therein and designated by the reference numeral 220 is a third embodiment of a guide apparatus for guiding the moving web of material 12 via the tuft edges 22 and 24 thereof. The guide apparatus 220 is provided with a base 222. A platform 224 is pivotally supported by the base 222 so that the platform 224 can pivot angularly over a predetermined range in an identical manner as the platform 34 pivots about the base 32, hereinbefore described with reference to FIGS. 1 and 2. Three parallel steering rollers 226, 228, and 230, rotatable about an axis (not shown) extending transversely of a web direction of travel are provided. The platform 224 is provided with a first end 232 and an opposing second end 234 spaced a distance from the first end 232 thereof. The steering roller 226 is rotatably mounted near the first end 232 of the platform 224 to form an entry roller. The steering roller 230 is rotatably mounted near the second end 234 of the platform 224 to form an exit roller.

The steering roller 228 is provided in between the steering roller 226 and the steering roller 230, and functions to alter a travel path 236 of the material 12 in a substantially perpendicular direction 238 relative to a web direction of travel 240 extending between the steering roller 226 and the steering roller 230. The movement of the travel path 236 in the direction 238 functions to increase the amount of wrap of the material 12 about the steering rollers 226 and 230, and to provide clearance such that a pair of sensors 244 can be disposed across the steering roller 230.

Only one sensor 244 is shown in FIG. 11 for purposes of clarity. The sensor 244 operates identically as the sensors 60*a* and 60*b* hereinbefore described in detail with reference to FIGS. 4 and 5. However, for purposes of clarity, the construction of the sensor 244 will be generally described. The sensor 244 is provided with a bracket 246 having a first end 248 and a second end 250. The sensor 244 defines a bent material receiving space 252 which is sized to receive at least a portion of the steering roller 230, and the bent portion 86 of the material 12 traveling over the steering roller 230. It should be noted that the bent material receiving space 252 must be provided with a length 253 which is sufficient to accept the lateral movement of the steering roller 230 as the platform 224 is pivoted about a pivot point 254 spaced a distance from the first end 232 of the platform 224. The lateral movement of the steering roller 230 is designated in FIG. 11 via the dashed lines 256. The length 253 will depend upon many factors, such as the dimensions of the guide apparatus 220, the width of the steering roller 230 and the pivot range of the platform 224. However, it should be noted that the length 253 will generally be sufficient to provide at least about ½ inch of lateral movement in each direction in which the platform 224 will be pivoted.

The sensor 244 is provided with a transmitter 258 and a receiver 260. The transmitter 258 transmits a sensor media 262 to be received by the receiver 260. The sensor media 262 can be identical to the sensor media 98 which was hereinbefore described with reference to FIGS. 3–5. The sensor 244 is provided with a mounting tab 264 for mounting the sensor to a rigid fixed object 266, such as the mounting frame 56 hereinbefore described with reference to FIG. 2. The rigid fixed object 266 is separate from the platform 224 such that the sensors 244 are stationary as the platform 224 pivots. The sensor media 262 is disposed in a parallel relation to the base 222 of the guide apparatus 220 so that the sensor media 262 always passes through the tuft portion 14 at the same height as the platform 224 pivots. Although the steering roller 228 has been described herein as being rotatably mounted on the platform 224, it should be noted that in one embodiment the steering roller 228 may be a non-rotatable bar mounted to the platform 224 such that the material 12 slides across such bar as the web of material 12 moves through the travel path 236.

The output of the sensors 244 is supplied to a controller (not shown for purposes of clarity) which operates in an identical manner as the controller 78 hereinbefore described with reference to FIGS. 1 and 2 to provide control signals to a guide drive assembly (also not shown for purposes of clarity) constructed identically as the guide drive assembly 83 hereinbefore described with reference to FIGS. 1 and 2.

Figure 12:
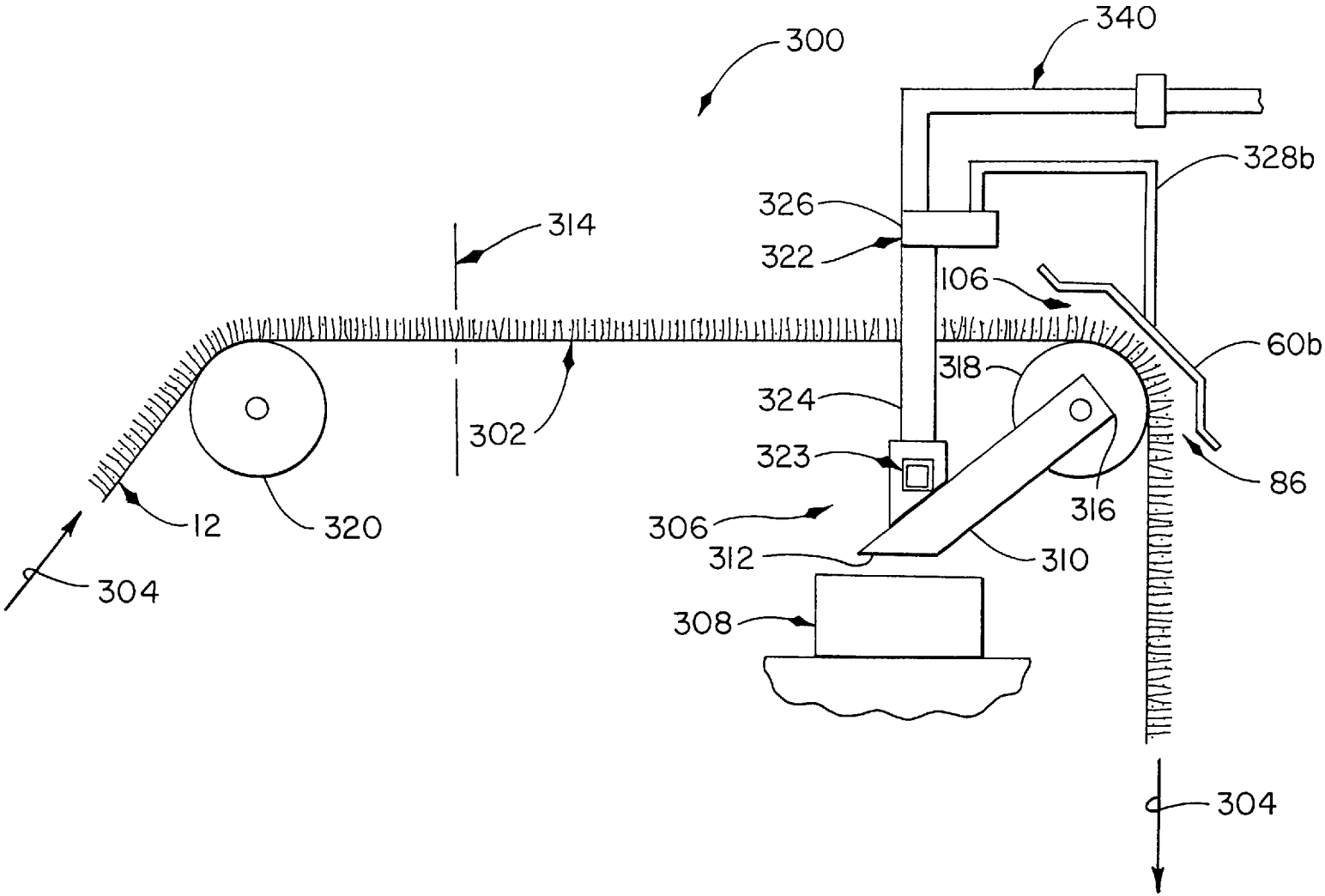
FIG. 12 is a side elevational view of a fourth embodiment of a guide apparatus constructed in accordance with the present invention.
Figure 11:
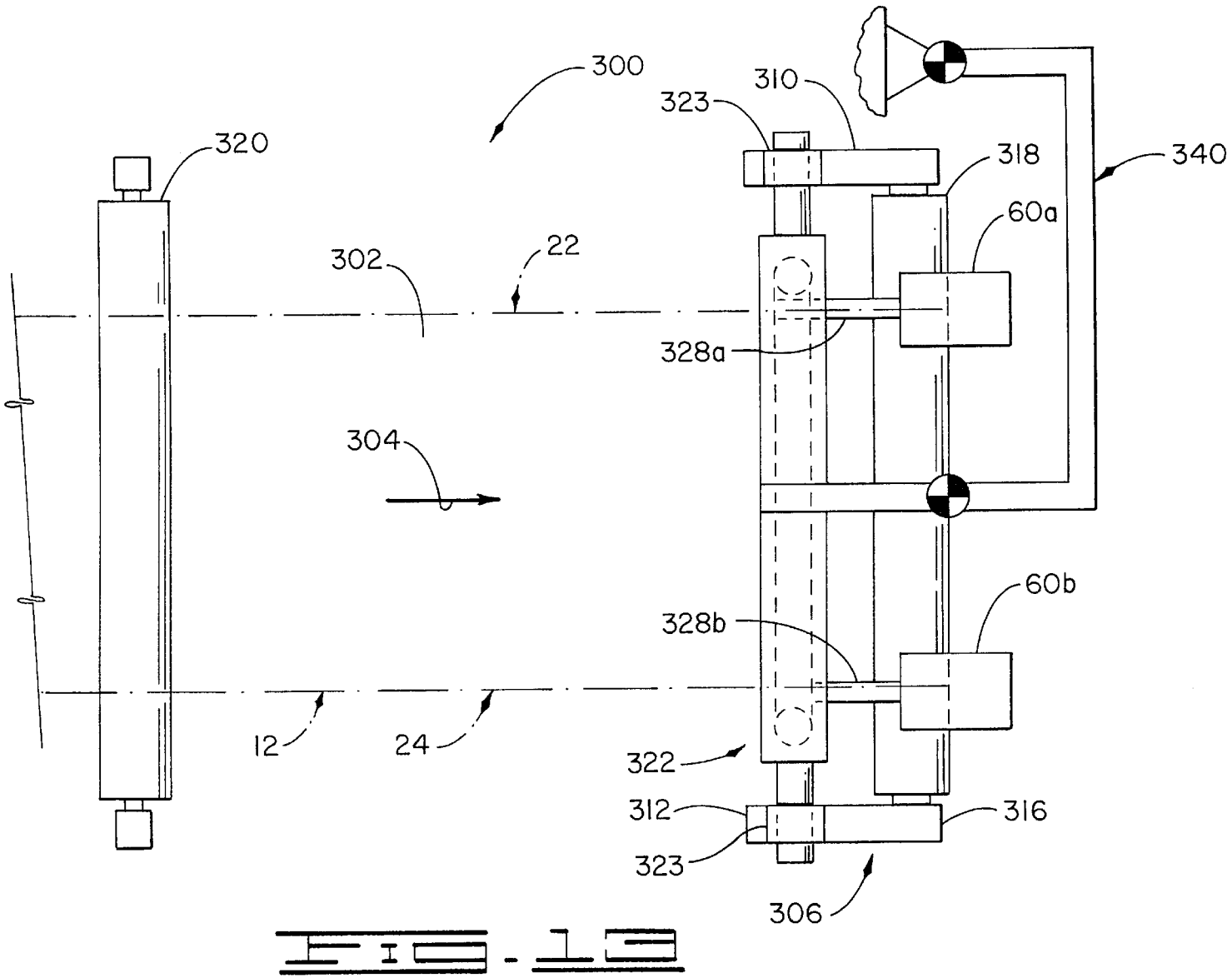

Referring now to FIGS. 12 and 13, depicted therein and designated by the reference numeral 300 is yet another embodiment of a guide apparatus constructed in accordance with the present invention for guiding the continuous web of material 12. The web of material 12 is generally movable through a travel path 302 in a web direction 304.

The guide apparatus 300 is provided with a conventional steering guide 306 having a base 308 supported on a fixed object, such as a floor. The steering guide 306 is provided with a platform 310 which has a first end 312 pivotally mounted and supported on the base 308 to pivot about a pivot point 314 over a predetermined pivot range. The platform 310 extends angularly from the base 308, substantially as shown and terminates at a second end 316. At least one steering roller 318 is mounted to the platform 310 near the second end 316 thereof. The steering roller 318 is positioned transverse to the web direction 304 of the travel path 302.

A support roller 320 which is not supported by the pivotal platform 310 is disposed in the travel path 302 of the web of material 12 and positioned generally transverse to the web direction 304. As shown in FIGS. 12 and 13, the web of material 12 travels sequentially over the support roller 320 and the steering roller 318 as the material 12 travels along the travel path 302.

A sensor positioner assembly 322 is slidably connected to the platform 310 via slidable connections 323 such that the sensor positioner assembly 322 can slide in a substantially parallel plane with respect to the steering roller 318. The sensor positioner assembly 322 is substantially identical in construction and function as the sensor positioner assembly 168 hereinbefore described with reference to FIGS. 6–9, except that the sensor positioner assembly 322 is provided with a spacer bracket 324 positioned between a housing 326 of the sensor positioner assembly 322 and the slidable connections 323 connecting the sensor positioner assembly 322 to the platform 310 so as to position the housing 326 of the sensor positioner assembly 322 generally above the web of material 12.

The sensor positioner assembly 322 supports the sensors 60*a* and 60*b* via the linkages 328*a* and 328*b*, respectively, such that the bent portion 86 of the material 12 and at least a portion of the steering roller 318 are disposed in the bent material receiving space 106 (as hereinbefore described with reference to FIG. 4) such that the sensors 60*a* and 60*b* can provide output signals indicative of the transverse position or lateral deviation of the tuft edges 22 and 24 of the material 12 as the material 12 moves through the travel path 302.

The output of the sensors 60*a* and 60*b* is supplied to a controller (not shown in FIGS. 12 and 13 for purposes of clarity) which operates in an identical manner as the controller 78 hereinbefore described with reference to FIGS. 1 and 2 to provide control signals to the sensor positioner assembly 322, and a guide drive assembly (also not shown in FIGS. 12 and 13 for purposes of clarity) constructed identically as the guide drive assembly 83 hereinbefore described with reference to FIGS. 1 and 2.

The guide apparatus 300 is further provided with a centering linkage assembly 340. The centering linkage assembly 340 is constructed and functions identically to the centering linkage assembly 182 hereinbefore described with reference to FIGS. 6–9.

It should be understood that the guide apparatuses 10, 150, 220 and 300 of the present invention are not limited to the particular wrap styles of the web of material 12 about the rollers as shown and described herein. The webs of material 12 can be wrapped or threaded about the rollers of the guide apparatuses 10, 150, 220 and 300 in any appropriate configuration so long as there is sufficient friction or traction between the rollers and the web of material 12 for guiding.

Changes may be made in the embodiments of the invention described herein, or in the parts or the elements of the embodiments described herein, or in the steps or sequence of steps of the methods described herein, without departing from the spirit and/or the scope of the invention as defined in the following claims.

What is claimed is:

1. A guide apparatus for guiding a moving web of material having a tuft portion mounted on a backing portion such that the backing portion extends outwardly from the tuft portion to form a pair of opposing tuft edges, the web being movable in a web direction through a travel path threaded through the guide apparatus, the guide apparatus comprising:

a base;

a platform pivotally mounted on the base to pivot about a pivot range, at least one steering roller being mounted on the platform and disposed transversely of the web direction of travel when the web travels across the platform;

bending means disposed adjacent to the travel path of the web for engaging the backing portion of the web and for forming a bent portion of the web when the web travels across the bending means;

a sensor positioned substantially adjacent to the travel path of the web, the sensor comprising:

a transmitter transmitting a sensor media, the transmitter being positioned adjacent to the tuft portion of the web when the web travels across the bending means;

a receiver positioned adjacent to the tuft portion of the web and being positioned to receive at least a portion of the sensor media transmitted by the transmitter, the transmitter and the receiver being positioned such that at least a portion of the tuft portion of the web is disposed between the transmitter and the receiver when the web travels across the bending means so that at least a portion of the sensor media intersects at least a portion of one tuft edge of the web to sense a lateral position of the tuft edge and to provide an output signal indicative of the lateral position of the tuft edge when the web travels through the travel path;

control means for generating control signals responsive to the signals produced by the sensor for automatically correcting a deviation from a predetermined position of the web position; and platform drive means responsive to the control signals generated by the control means for pivoting the platform and thereby controlling the angular position of the platform relative to the base.

2. A guide apparatus as defined in claim 1, further comprising:

a mounting frame provided separately from the platform; and wherein the sensor is mounted to the mounting frame.

3. A guide apparatus as defined in claim 1, wherein the bending means is the steering roller.

4. A guide apparatus as defined in claim 1, further comprising a mounting frame provided separately from the platform; and wherein the bending means includes a stationary bar mounted to the mounting frame and positioned in the travel path of the material, the bar having an axis extending transversely of the web direction of travel wherein the transmitter and the receiver of the sensor are positioned in close proximity to the stationary bar to sense the lateral position of the edge of the web as the web travels across the stationary bar.

5. A guide apparatus as defined in claim 1, wherein the steering roller has an axis and the platform has a first side and a second side, and wherein the guide apparatus further comprises:

a sensor positioner assembly having a central axis, the axis of the sensor positioner assembly being disposed in a substantially parallel relationship with the axis of the steering roller, the sensor positioner assembly being slidably mounted to the platform such that the sensor positioner assembly can slide linearly along its central axis in a first direction away from the first side, and in a second direction away from the second side, the sensor being mounted on the sensor positioner assembly; and a rigid centering linkage means attached to the sensor positioner assembly for moving the sensor positioner assembly in the first direction when the platform pivots to correct to the first side thereof, and for moving the sensor positioner assembly in the second direction when the platform pivots to correct to the second side thereof whereby the centering linkage means maintains the sensor in a fixed physical relationship to the tuft edge as the platform pivots.

* * * * *